US005420670A

United States Patent [19]

Fukuoka et al.

[11] Patent Number: 5,420,670

[45] Date of Patent: May 30, 1995

[54] PRINTING APPARATUS

[75] Inventors: Toshimi Fukuoka; Hideki Matsuzaka, both of Kanagawa, Japan

[73] Assignee: Sony Corporation, Japan

[21] Appl. No.: 113,662

[22] Filed: Aug. 31, 1993

[30] Foreign Application Priority Data

Sep. 24, 1992 [JP] Japan ..... 4-254261

[51] Int. Cl.[6] ..... G03G 15/00

[52] U.S. Cl. ..... 355/211; 355/72; 355/308; 355/311

[58] Field of Search ..... 355/308, 309, 311, 310, 355/210, 211, 212, 213, 26, 64, 79, 72, 54, 107; 358/303, 304; 347/105, 106; 346/107 R, 135.1

[56] References Cited

U.S. PATENT DOCUMENTS

| | | | |
|---|---|---|---|
| 3,834,808 | 9/1974 | Takahashi et al. | 355/200 |
| 4,745,442 | 5/1988 | Oshikoshi et al. | 355/28 |
| 4,843,435 | 6/1989 | Horiguchi et al. | 355/100 |
| 4,908,667 | 3/1990 | Ikeura et al. | 355/256 |
| 4,932,068 | 6/1990 | Sonoda | 355/77 |
| 4,953,805 | 9/1990 | Rauh | 242/58.6 |
| 4,956,649 | 9/1990 | Sakai et al. | 346/107 R |
| 5,019,856 | 5/1991 | Onashi et al. | 355/27 |
| 5,103,255 | 4/1992 | Sonobe | 355/27 |

*Primary Examiner*—A. T. Grimley
*Assistant Examiner*—Thu A. Dang
*Attorney, Agent, or Firm*—Ronald P. Kananen

[57] ABSTRACT

A printing apparatus includes a photoconductor and a photoconductor transporting mechanism. The photoconductor is in the form of a plurality of cut sheets and stacked in a tray. One cut sheet of the photoconductor is transported to an electrifying device where the cut sheet is electrostatically charged. The charged cut sheet is delivered to an exposing device and exposed therein to a laser beam to thereby have an electrostatic latent image thereon. The cut sheet with the latent image is transported to a developing section and developed therein. The developed latent image is transferred in a transferring section onto a recording paper supplied thereto. The transferred image is fixed on the recording paper in a fixing section. After transferring, the cut sheet returns to the tray for the repeated use.

11 Claims, 1 Drawing Sheet

PRINTING APPARATUS

BACKGROUND OF THE INVENTION

The present invention relates to a printing apparatus used for data output in electric data recording devices, for instance, wordprocessor, video tape recorder, electronic still camera and the like.

One example of such a printing apparatus is a laser printer which is well known in optical and electrophotographic fields. Some of the laser printers include a rotary drum rotatably disposed in a printer housing or an endless belt movably supported by a plurality of guide rollers which are disposed in the housing. The rotary drum or endless belt has on a circumferential surface thereof a layer of photosensitive material , for instance organic photo conductor characterized by photoconductivity. The photosensitive material layer on the surface of the rotary drum or endless belt is electrostatically charged and then exposed to a laser beam during the motion of the rotary drum or endless belt. A portion of the photosensitive material layer which is exposed to the laser beam, is electrically discharged. An electrostatic latent image is formed on the layer as a result of the exposure to the laser beam, and then developed by means of toner. The toner-developed image is transferred onto a sheet of recording medium by heating and pressing, and then fixed in such a manner as heating and pressing. Thus, an image corresponding to that of data transmitted to the laser printer is printed onto the sheet of recording medium.

When the photosensitive material layer is deteriorated due to oxidization or damage during its repeated use, the rotary drum or endless belt must be as a whole replaced by a new one. Such a replacement work is inconvenient and particularly, the replacement of the endless belt is complicated.

Further, since the rotary drum or endless belt occupy a relatively large installation space in the conventional printer, other components must be arranged or installed in the remainder small space in the printer.

In addition, one cycle of a printing operation for printing onto one sheet of recording medium in the conventional printer includes the sequential steps of exposure, development, transfer, fixing and the like. The steps are performed in turn but not individually nor simultaneously. Therefore, in such a case that a plurality of sheets of recording medium are printed in the conventional printer, an increased period of time is required therefor.

Furthermore, in order to improve accuracy of the printing operation, the conventional printer employing the endless belt is required to be supplementally provided with a device for preventing offset of the endless belt during travel thereof. The provision of the offset preventing device leads to a complicated structure of the conventional printer.

SUMMARY OF THE INVENTION

Accordingly, an object of the present invention is to provide a printing apparatus capable of performing individually and simultaneously plural sequential steps of the printing operation to therefore serve for reducing a period of time required for printing of a plurality of sheets of recording medium.

Another object of the present invention is to provide a printing apparatus capable of readily replacing a photosensitive material layer by a new one in a case where the layer is damaged or deteriorated during its use.

According to the present invention, there is provided in a printing apparatus;

means for feeding a recording medium;
a photoconductor;
a receptacle for receiving the photoconductor;
means for transporting the photoconductor;
means for electrifying the photoconductor;
means for exposing the photoconductor to light to form an electrostatic latent image on the photoconductor;
means for developing the electrostatic latent image;
means for transferring the developed electrostatic latent image onto the recording medium; and
means for fixing the transferred image on the recording medium;
wherein the photoconductor is in the form of a plurality of cut sheet members.

According to another aspect of the present invention, there is provided a photoconductor for use in a printing apparatus, comprising:

a substrate in the form of a cut sheet; and
a layer of a photoconductive material formed on the substrate;
wherein a plurality of the photoconductors are individually and simultaneously transported in the printing apparatus and recycled therein.

DESCRIPTION OF THE PREFERRED EMBODIMENT

Figure 1:
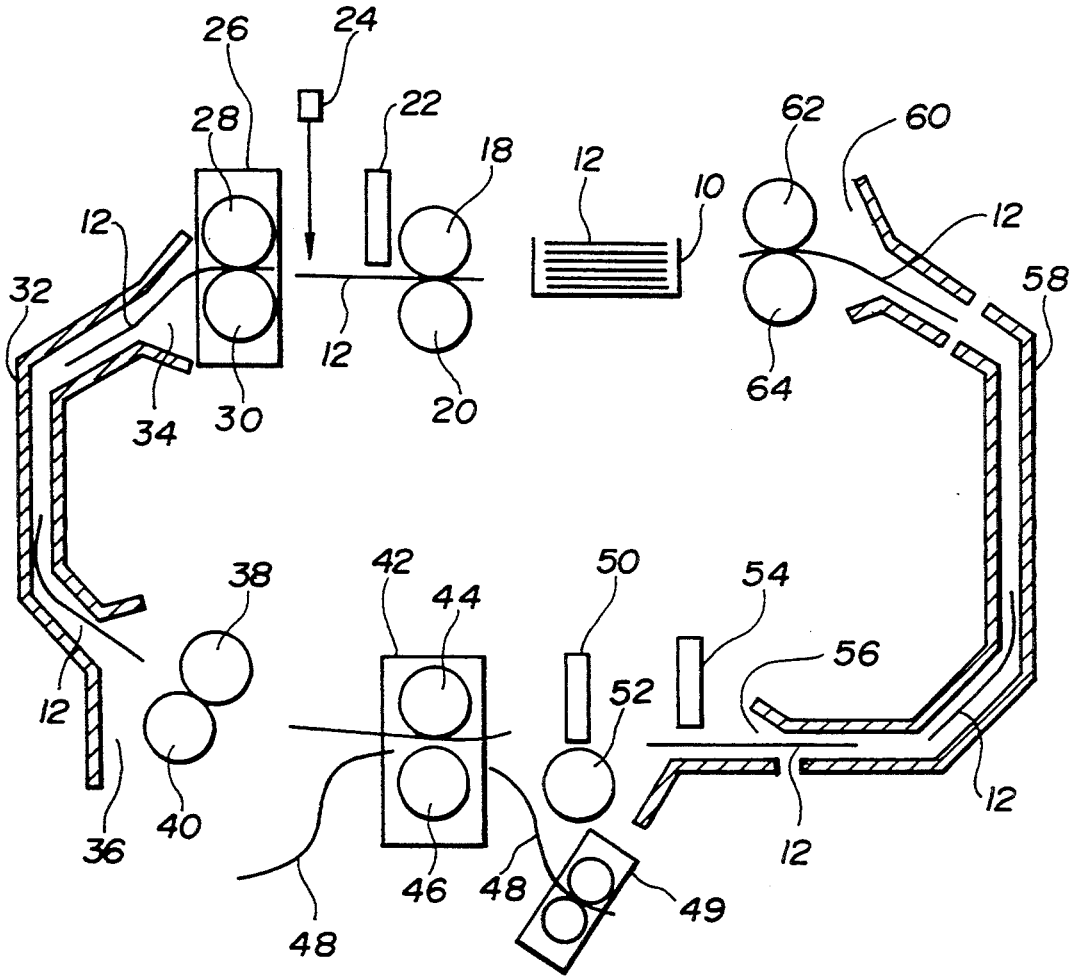
FIG. 1 is an explanatory diagram of a printing apparatus according to the present invention, showing sequential steps of a printing operation thereof.

Referring now to FIG. 1, there is shown a printing apparatus according to the present invention which includes a tray 10 detachably mounted on a housing (not shown) of the printing apparatus. The tray 10 receives therein a plurality of photoconductor members 12 which are in the form of cut sheets having a given identical size.

Figure 2:
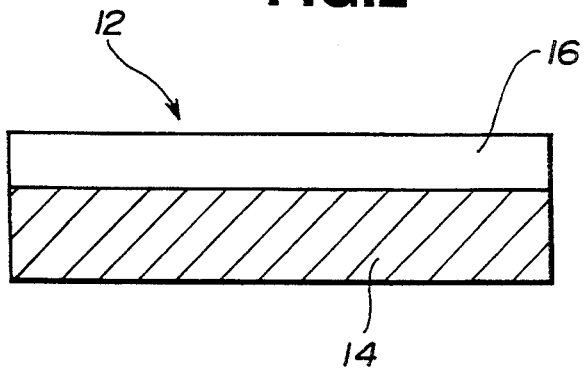
FIG. 2 is a schematic sectional view of a cut sheet of a photoconductor member used in the printing apparatus.

As seen in FIG. 2, the photoconductor member 12 comprises a resin substrate 14 and a layer 16 of a photoconductive material, for instance an organic photoconductor which is applied onto the resin substrate 14. The photoconductive material is characterized in that it is electrically discharged in response to exposure to light.

The photoconductor member 12 is fed from the tray 10 to a pair of guide rollers 18 and 20 which are disposed in opposed relation to each other. The photoconductor member 12 is interposed between the guide rollers 18 and 20 and delivered by rotation thereof to an electrifying device 22 which is arranged adjacent the guide rollers 18 and 20. The electrifying device 22 applies a uniform electrostatic charge onto a surface of the layer 16 of the photoconductor member 12. An exposing device 24 is disposed adjacent the electrifying device 22 and includes a laser source radiating a laser beam as indicated by an arrow in FIG. 1. Thus, the layer 16 of the photoconductor member 12 is exposed to the laser beam to selectively dissipate electrostatic charge thereon so that an electrostatic latent image is formed thereon. Another kind of an optical beam radiated from a light source may be substituted for the laser beam.

A developing section 26 including a pair of rollers 28 and 30 is arranged in a given place in the housing such that the photoconductor member 12 with the electrostatic latent image is guided to the rollers 28 and 30 opposed to each other. In this section 26, the electrostatic latent image on the photoconductor member 12 is subject to development by means of toner such that the toner is electrostatically attached onto the latent image to form a toner pattern thereon. The toner pattern is toned corresponding to a tone of an original image of an input data which is transmitted to the printing apparatus.

In the vicinity of the developing section 26 is disposed an inlet 34 of a supply duct 32 through which the toned photoconductor member 12 is transported to an outlet 36 adjacent which opposed guide rollers 38 and 40 are disposed. The opposed guide rollers 38 and 40 deliver or guide the photoconductor member 12 to a transferring section 42 which includes a pair of rollers 44 and 46 as shown in FIG. 1.

In the transferring section 42, a recording paper 48 is supplied onto the roller 46 while the photoconductor member 12 is fed onto the roller 44. The roller 46 is urged against the roller 44 so that the recording paper 48 is contacted with the photoconductor member 12. Then, the toner pattern is transferred from the photoconductor member 12 onto the recording paper 48 in a heating and pressing manner. After transferring, the recording paper 48 is fed via a pair of rollers to a fixing section 49 in which the transferred toner pattern on the recording paper 48 is fixed. Thus, a printing of the image of the input data onto the recording paper 48 is performed.

Adjacent the transferring section 42 is arranged a cleaning device 50 for removing the toner which remains on the photoconductor member 12 after transferring operation. The photoconductor member 12 is fed by a guide roller 52 of the cleaning device 50 to a charge-remover device 54 for removing electrostatic charge remaining on the photoconductor member 12.

The charge-remover device 54 is arranged in an inlet 56 of a return duct 58 as seen on the right hand of FIG. 1. The photoconductor member 12 charge-removed by the charge-remover device 54 is transported through the return duct 58 to a pair of guide rollers 62 and 64 which are disposed adjacent an outlet 60 of the return duct 58. The guide rollers 62 and 64 return the photoconductor member 12 to the tray 10.

When the printing operation starts, an initial uppermost one of the photoconductor members 12 stacked in the tray 10 is drawn therefrom by the guide rollers 18 and 20 and transported via the electrifying device 22 and the exposing device 24, to the developing section 26. The photoconductor member 12 is in turn subject to respective processing steps carried out in those devices and then has the toner pattern thereon in the developing section 26. During the transportation of the initial photoconductor member 12, the next photoconductor member 12 is drawn from the tray 10 and-transported to the respective sections in the same manner. This transportation of the next photoconductor member 12 starts after a lapse of a predetermined period of time from that of the initial one. Thus, a plurality of the subsequent photoconductor members 12 are repeatedly supplied.

When the photoconductor member 12 fed through the supply duct 32 reaches the transferring section 42, the toner pattern on the photoconductor member 12 is transferred onto the recording paper 48. The toner pattern transferred is then fixed in the fixing section 49. Thus, the image is printed on the recording paper 48. Subsequent to completion of printing on the recording paper 48, the photoconductor member 12 is transported to the cleaning device 50 where any remaining toner on the photoconductor is removed therefrom. Then, the photoconductor member 12 is fed to be charge-remover device 54 to dissipate any remaining electrostatic charge thereon. After leaving the charge-remover device 54, the photoconductor member 12 is delivered through the return duct 58 into the tray 10. Then, the photoconductor member 12 returns to the tray 10 and re-stacked therein for the repeated use. Similarly, the following photoconductor members 12 are in turn subject to transferring, cleaning and charge-removing and then returns to the tray 10 in the same manner.

As be apparently appreciated from the above discussion, a plurality of photoconductor members are allowed to be individually and simultaneously subject to different steps of the printing operation which include electrifying, exposing, developing, and transferring. In a case where plural pages or plural copies are to be printed, it would be appreciated that a total printing time required therefor is considerably reduced in accordance with the present invention.

Further, in a case where any photoconductor member is damaged, only the photoconductor member damaged is readily removed from the tray and replaced with a new one without any skilled replacement work while the whole of the rotary drum or endless belt must be replaced in the conventional printing apparatus.

In addition, since the photoconductor member has a relatively small heat capacity as well as the conventional photoconductor on the endless belt, thermal radiation is facilitated during transportation thereof. Further, the printing apparatus of the present invention dispenses with an endless belt offset preventing device which is provided in the conventional printing apparatus employing the endless belt.

Furthermore, the sheet-shaped photoconductor members stacked in the tray serve for reducing the installation space in the apparatus housing, as compared with the rotary drum and the endless belt installed in the conventional printing apparatus.

What is claimed is:

1. In a printing apparatus:

means for feeding a recording medium;

a receptacle;

a stack of pre-cut discrete photoconductor sheets which are received in said receptacle;

means for transporting a photoconductor sheet from said stack;

means for electrifying said photoconductor sheet;

means for exposing said photoconductor sheet to light to form an electrostatic latent image on said photoconductor sheet;

means for developing the electrostatic latent image;

means for transferring the developed electrostatic latent image onto the recording medium;

separating and fixing means for separating said recording medium from recording medium and fixing the transferred image on the recording medium and means for recycling said photoconductor sheet from said separating and fixing means to said stack in said receptacle.

2. A printing apparatus as claimed in claim 1, wherein each of said photoconductor sheets includes a substrate and a layer of a photoconductive material formed on the substrate.

3. A printing apparatus as claimed in claim 1, wherein a plurality of photoconductor sheets can be sequentially extracted from said receptacle and individually subject to electrifying, exposing, developing, transferring, and recycling.

4. A printing apparatus as claimed in claim 1, wherein said receptacle is detachably disposed in the printing apparatus.

5. A printing apparatus as claimed in claim 2, wherein said photoconductive material includes an organic photoconductor.

6. A printing apparatus, comprising:

a substrate in the form of a cut sheet;

a layer of a photoconductive material formed on said substrate; and means for individually transporting said sheets through said printing apparatus and for recycling each cut sheet a plurality of times.

7. A photoconductor as claimed in claim 6, wherein said photoconductive material includes an organic photoconductor.

8. A printing apparatus as claimed in claim 1, further comprising a cleaning device which is operatively interposed between said separating and fixing means for cleaning said photoconductor sheets before being returned to said stack in said receptacle.

9. A printing apparatus as claimed in claim 1, further comprising a charge removing device which is operatively interposed between said separating and fixing means for removing residual charge from said photoconductor sheets before being returned to said stack in said receptacle.

10. A method of printing comprising:

extracting a pre-cut photo photoconductor sheet from a stack of pre-cut photoconductor sheets;

applying a charge to said pre-cut photoconductor sheet;

exposing said charged pre-cut photoconductor sheet to a predetermined beam of light in a manner to discharge predetermined portions of said charged pre-cut photoconductor sheet and form a latent electrostatic image thereon;

applying toner to the latent electrostatic image formed on said pre-cut photoconductor sheet;

pressing said pre-cut photoconductor sheet against a sheet of paper to transfer the image onto the sheet of paper;

separating the sheet of paper from said pre-cut photoconductor sheet;

cleaning said pre-cut photoconductor sheet by removing residual toner;

removing residual charge from said pre-cut photoconductor sheet; and recycling said pre-cut photoconductor sheet to said stack.

11. A printing apparatus comprising:

means for extracting a pre-cut photo photoconductor sheet from a stack of pre-cut photoconductor sheets;

means for applying a charge to said pre-cut photoconductor sheet;

means for exposing said charged pre-cut photoconductor sheet to a predetermined beam of light in a manner to discharge predetermined portions of said charged pre-cut photoconductor sheet and form a latent electrostatic image thereon;

means for applying toner to the latent electrostatic image formed on said pre-cut photoconductor sheet;

means for pressing said pre-cut photoconductor sheet against a sheet of paper to transfer the image onto the sheet of paper;

means for separating the sheet of paper from said pre-cut photoconductor sheet;

means for cleaning said pre-cut photoconductor sheet by removing residual toner;

means for removing residual charge from said pre-cut photoconductor sheet; and means for recycling said pre-cut photoconductor sheet to said stack.

* * * * *